US007081073B1

(12) United States Patent
Smith

(10) Patent No.: US 7,081,073 B1
(45) Date of Patent: Jul. 25, 2006

(54) FOOT RETAINING DEVICE FOR INVERSION EXERCISER

(75) Inventor: Lawerence C. Smith, Sumner, WA (US)

(73) Assignee: Roger C. Teeter, Sumner, WA (US)

( * ) Notice: Subject to any disclaimer, the term of this patent is extended or adjusted under 35 U.S.C. 154(b) by 59 days.

(21) Appl. No.: 11/005,899

(22) Filed: Dec. 7, 2004

(51) Int. Cl.
*A63B 26/00* (2006.01)

(52) U.S. Cl. ..... 482/145; 482/144; 482/143; 601/23; 128/71

(58) Field of Classification Search ..... 482/143–145; 128/69–74; 5/610, 613; 601/23, 27
See application file for complete search history.

(56) References Cited

U.S. PATENT DOCUMENTS 1,693,810 A * 12/1928 Daniels et al. ..... 482/144
4,444,178 A * 4/1984 Kuo ..... 482/144
4,494,532 A * 1/1985 Masuda et al. ..... 482/38
4,515,152 A * 5/1985 Teeter ..... 482/144
4,523,582 A * 6/1985 Barber ..... 602/36
4,624,458 A * 11/1986 Fendrik ..... 482/144
4,672,697 A * 6/1987 Schurch ..... 5/610
5,551,937 A 9/1996 Kwo ..... 482/144
5,718,660 A 2/1998 Chen ..... 482/144
6,030,325 A * 2/2000 Ottoson et al. ..... 482/144
6,637,055 B1 * 10/2003 Nanan ..... 5/610
6,814,691 B1 * 11/2004 Kuo ..... 482/145

* cited by examiner

*Primary Examiner*—Lori Amerson
(74) *Attorney, Agent, or Firm*—Charles E. Baxley

(57) ABSTRACT

An inversion exerciser includes a foot retaining device having a beam attached to a base to secure feet of user to the base, and having two fixed foot supports, a housing secured to the beam, a curved rack secured in the housing and having a number of teeth. A lever has one end rotatably attached to the housing and includes two movable foot supports movable toward and away from the fixed foot supports of the beam. A pawl is pivotally secured in the lever, and rotatable to engage with the teeth of the rack, and to selectively lock the lever to the beam, and a controlling device may control the pawl to engage with and to be disengaged from the teeth of the rack. A safety lock device is pivotally secured in the lever, and includes a tongue to selectively engage with the teeth of the rack and to selectively lock the lever to the beam by gravity force.

9 Claims, 11 Drawing Sheets

FOOT RETAINING DEVICE FOR INVERSION EXERCISER

BACKGROUND OF THE INVENTION

1. Field of the Invention

The present invention relates to a foot retaining device for inversion exerciser, and more particularly to a foot retaining device for inversion exerciser having a safety lock device to safely lock feet of users.

2. Description of the Prior Art

Various kinds of typical body inversion suspension exercise devices or exercisers for straightening spinal column have been developed and comprise a back rest rotatably or pivotally attached to a supporting structure, to support users, and to allow the users to conduct inversion or suspension exercises, or to allow the users to straighten their spinal columns.

For example, U.S. Pat. No. 5,718,660 to Chen discloses one of the typical exercisers for straightening spinal column, comprising a base and a cushion rotatably or pivotally attached to a support to support users thereon, and a foot retaining device attached to the base, to attach or secure the feet of the users to the base, and to prevent the users from being disengaged from the base, and thus to allow the users to conduct inversion or suspension exercises, or to straighten their spinal columns.

While conducting the inversion or suspension exercises, the users may be supported up-side-down, and may have their feet arranged above their bodies, and may thus have their weight mainly supported by the foot retaining device, such that the feet of the users are thus required to be safely locked to the base with the foot retaining device.

However, the foot retaining device of the typical inversion exercisers do not provide a secondary safety lock that will engage automatically by force of gravity when the user is inverted.

U.S. Pat. No. 5,551,937 to Kwo discloses one of the typical body inversion suspension exercise devices comprising a leg pressing rod adjustably attached to the back rest which is rotatably or pivotally attached to a supporting structure, to support the users, and a leg pressing rod attached to the back rest, to secure the feet of the users to the back rest. In addition, Kwo further provide a retaining ring pivotally attached to a height adjusting rod of the back rest, to selectively hook and secure an operating rod to the height adjusting rod, and to prevent the operating rod from being moved or rotated away from the height adjusting rod.

However, the users may have to bow their bodies, in order to rotate and engage the retaining ring onto the operating rod, and to anchor or secure the operating rod to the height adjusting rod. It is thus inconvenient for the users to engage onto and to disengage the retaining ring from the operating rod, particularly when the feet of the users are suspended above their bodies, or while the users are conducting the inversion or suspension exercises.

The present invention has arisen to mitigate and/or obviate the afore-described disadvantages of the conventional foot retaining devices for inversion exercisers.

SUMMARY OF THE INVENTION

The primary objective of the present invention is to provide a foot retaining device for inversion exerciser including a safety lock device to safely lock the feet of the users to a supporting base, and to prevent the users from being disengaged from the supporting base when the feet of the users are suspended above their bodies, or while the users are conducting the inversion or suspension exercises.

In accordance with one aspect of the invention, there is provided an inversion exerciser comprising a base rotatably attached to a stand, to support a user thereon, and a foot retaining device attached to the base, to secure feet of the user to the base. The foot retaining device includes a beam secure to the base, two fixed foot supports attached to the beam, a housing secured to the beam, a curved rack secured in the housing and having a number of teeth provided thereon. A lever includes a first end rotatably attached to the housing of the beam with a pivot shaft, the lever includes two movable foot supports attached thereto, and movable toward and away from the fixed foot supports of the beam by the lever, for retaining the feet of the user between the lever and the beam, a pawl is pivotally secured in the lever, and rotatable to engage with the teeth of the rack, in order to selectively lock the lever to the beam, and rotatable to be disengaged from the teeth of the rack, to free the lever and to allow the lever to be rotated relative to the beam, a controlling device may further be provided for controlling the pawl to engage with and to be disengaged from the teeth of the rack, and a safety lock device is pivotally secured in the lever, and includes a tongue provided on one end thereof, and arranged to selectively engage with the teeth of the rack and to selectively lock the lever to the beam by gravity force.

The safety lock device includes another end having a weight greater than that of the tongue, in order to force the tongue to engage with the teeth of the rack by the gravity force.

The lever includes a block secured therein and having a notch formed therein to slidably receive the safety lock device, and to limit a rotational movement of the safety lock device relative to the lever. The rack includes a stop extended therefrom, the block includes a catch extended therefrom, for engaging with the stop of the rack, and to limit a rotational movement of the lever relative to the beam.

The block includes a passage formed therein and communicating with the notch thereof, and a rod slidably received in the passage of the block and having a first end pivotally coupled to the pawl, to actuate the pawl to engage with or to be disengaged from the teeth of the rack.

The controlling device includes a spring engaged on the rod, and engaged between the block and the pawl, to bias the rod to rotate the pawl, and to disengaged the pawl from the teeth of the rack. The rod includes two washers-slidably engaged thereon, and engaged with the block and the pawl respectively, and the spring is engaged between the washers.

The controlling device includes an elbow having a middle portion rotatably secured in the beam with a pivot axle, and having a first end pivotally secured to the rod, and having an orifice formed in a second end thereof, a post slidably received in the lever and extended through the orifice of the elbow and having an enlarged head provided on one end thereof, for engaging with the elbow, and for rotating the elbow to actuate the pawl to engage with the teeth of the rack.

The controlling device includes a casing secured in an upper portion of the lever, and having a bore formed therein, to slidably receive an upper portion of the post, a spring engaged between the post and the casing, to bias the head of the post to engage with the elbow.

A knob is slidably engaged onto the lever and includes a stem extended downwardly therefrom and slidably engaged into the bore of the casing, and having a lower portion engaged with the post, for moving the post against the spring, to selectively disengage the head of the post from the elbow.

The casing includes a pin engaged therein, the stem includes an oblong hole formed therein to slidably receive the pin, and to limit a sliding movement of the stem and the knob relative to the lever. The knob includes a second spring engaged onto the stem and engaged between the knob and the casing, to bias the knob away from the casing.

The housing includes a cover secured thereto, and including a channel formed therein to slidably receive the lever. The beam includes a number of holes formed therein, to adjustably secure the beam of the foot retaining device to the base.

Each of the fixed foot supports includes a soft pad attached thereto, to comfortably support the feet of the user. The foot retaining device includes two foot pedals attached to the beam, to stably support the feet of the user.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
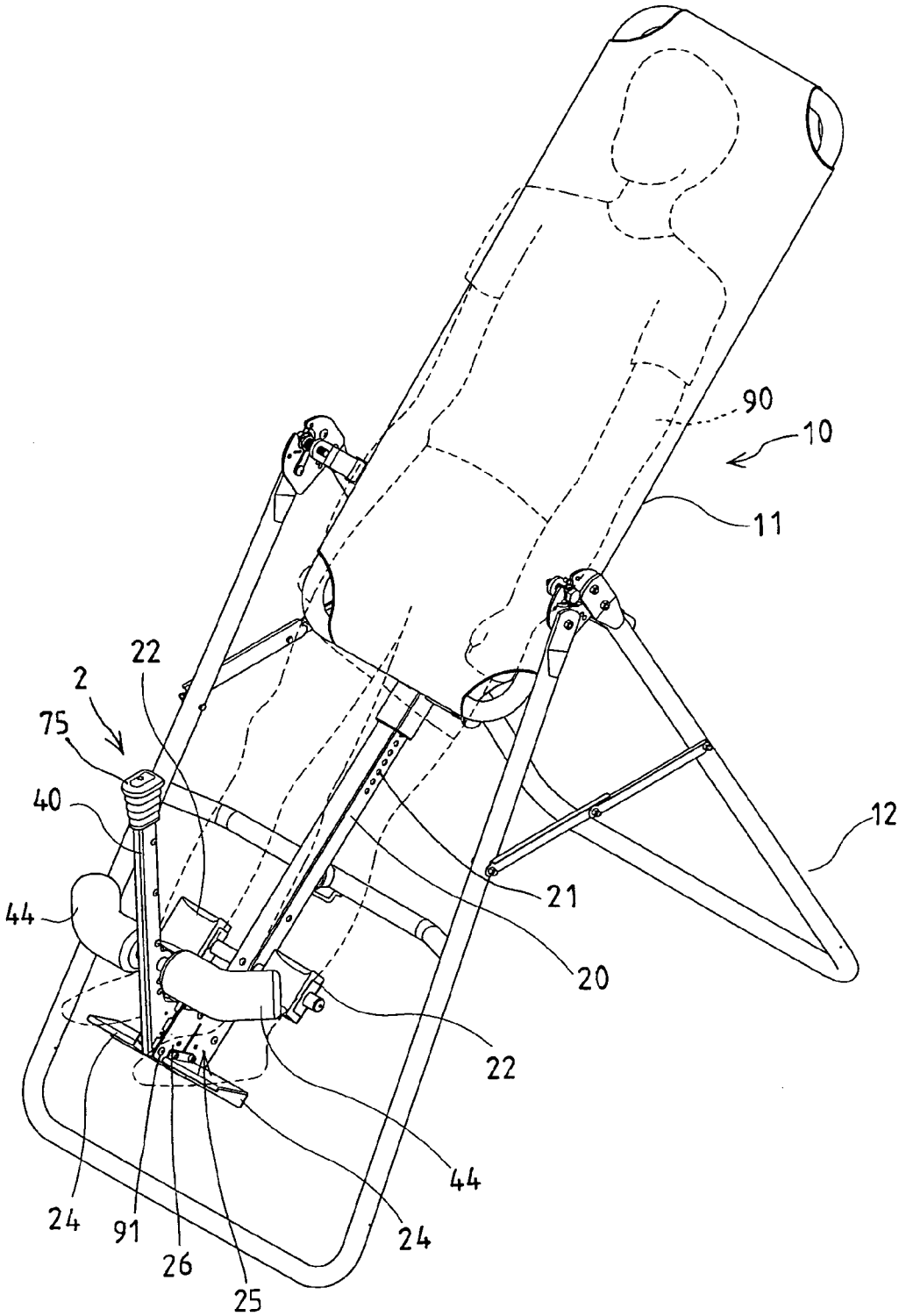
FIG. 1 is a perspective view of an inversion exerciser having a foot retaining device in accordance with the present invention.
Figure 2:
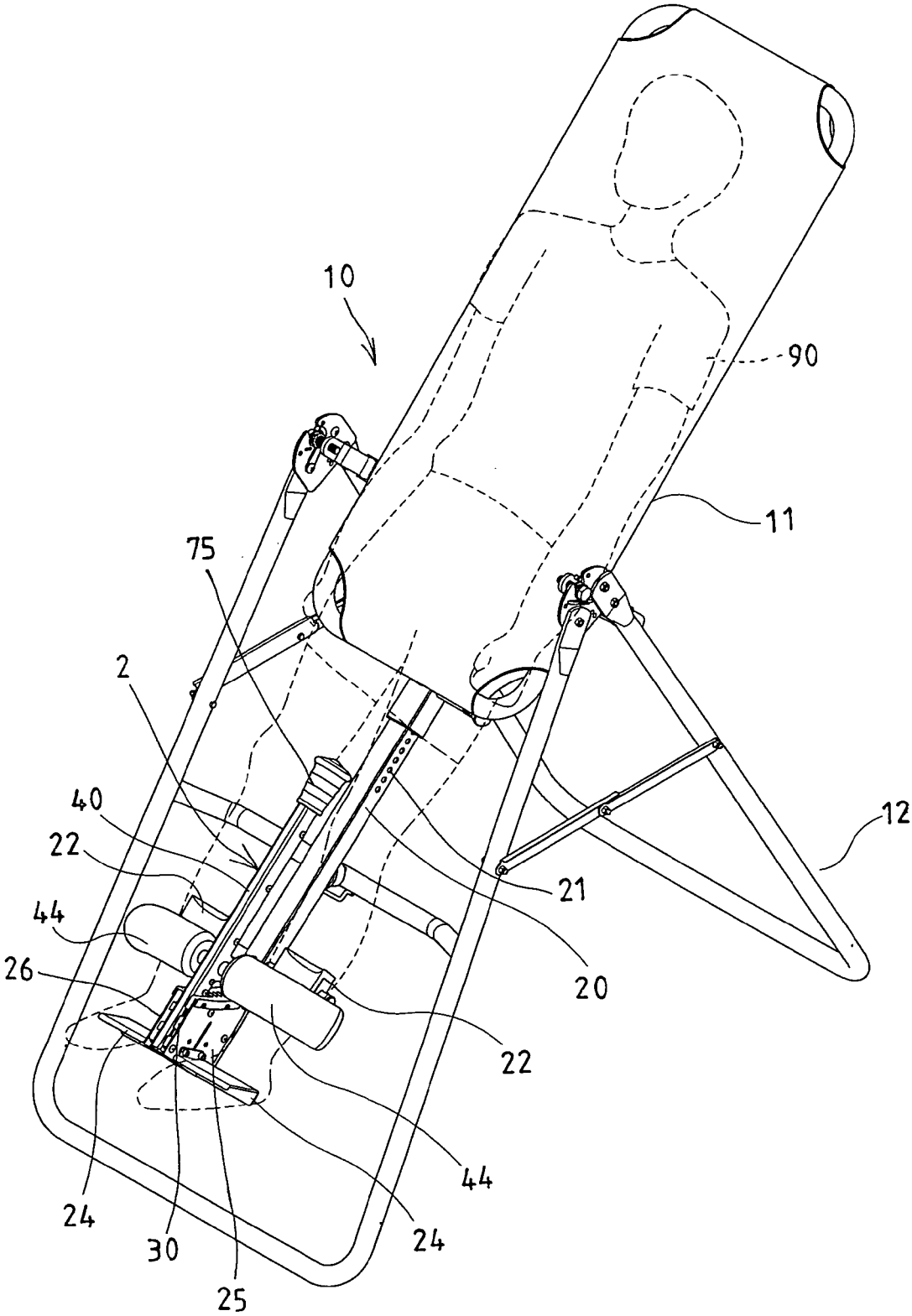
FIGS. 2, 3 are perspective views similar to FIG. 1, illustrating the operation of the foot retaining device for the inversion or suspension exerciser.
Figure 3:
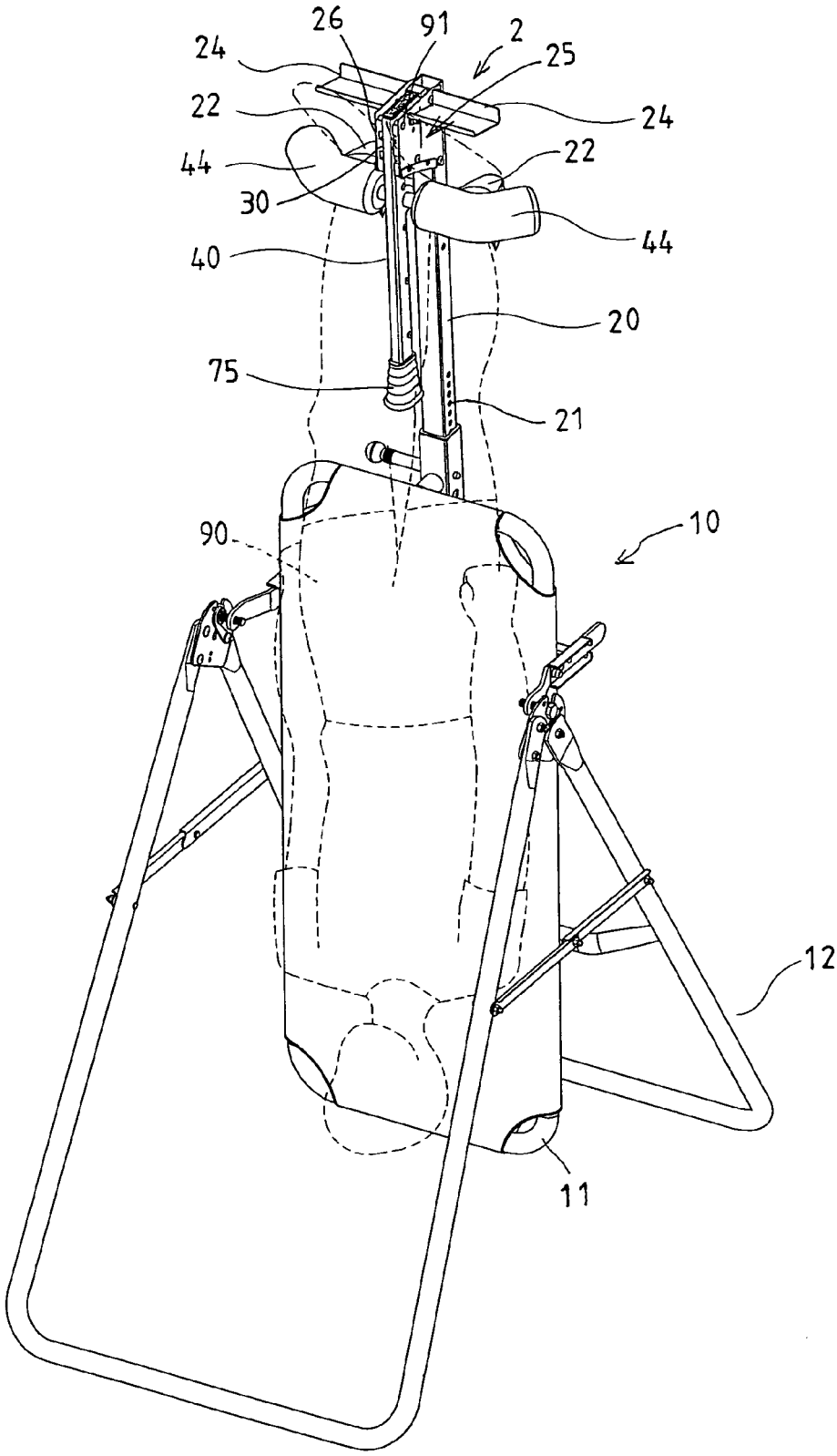

Referring to the drawings, and initially to FIGS. 1–3, an inversion exerciser 10 in accordance with the present invention comprises a base 11 rotatably or pivotally attached to a supporting stand 12, to support users 90 thereon, and a foot retaining device 2 attached to the base 11, to anchor or to secure the feet of the users 90 to the base 11, and to prevent the users 90 from being disengaged from the base 11, and thus to allow the users to conduct inversion or suspension exercises, or to straighten their spinal columns.

Figure 4:
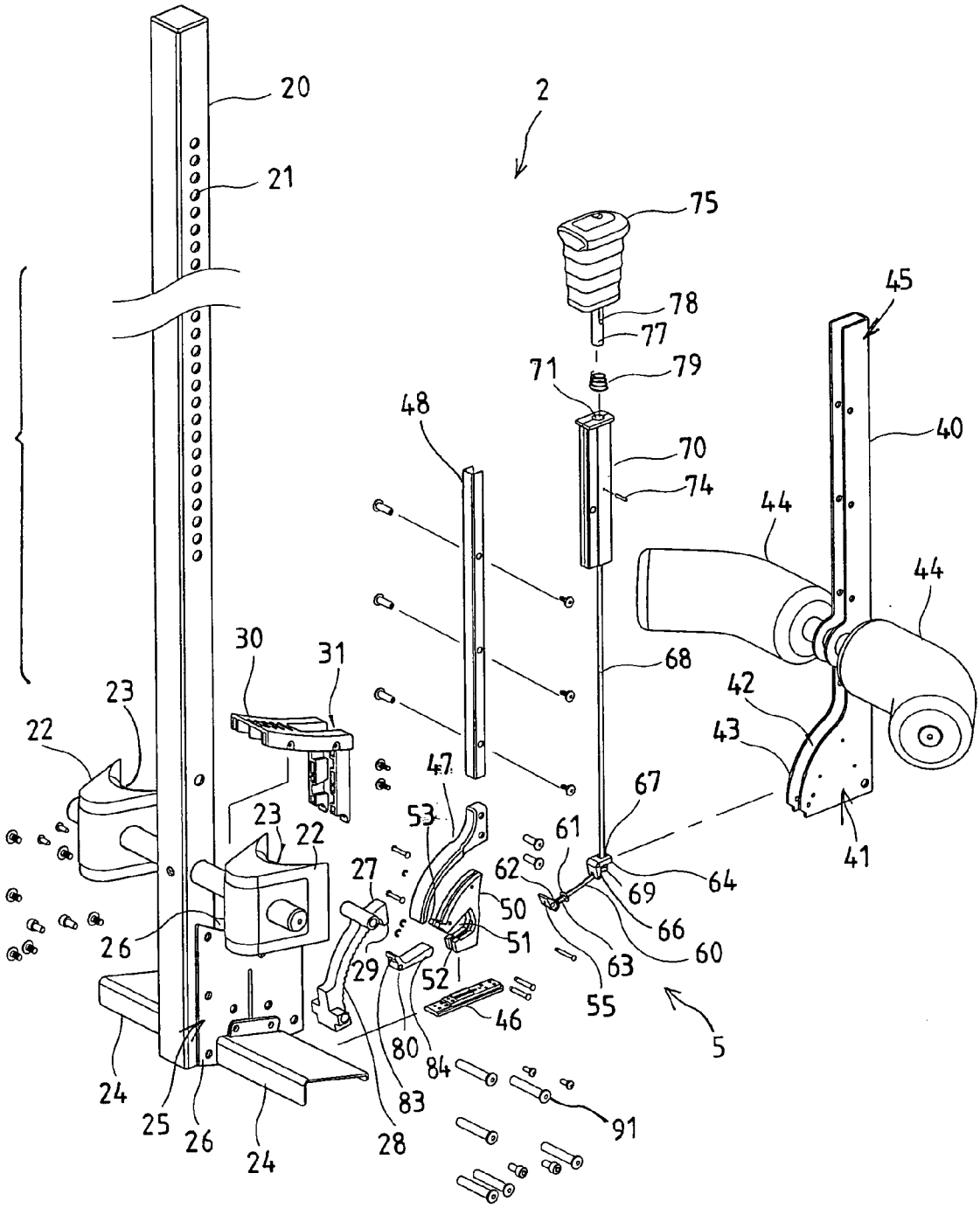
FIG. 4 is an exploded view of the foot retaining device for the inversion exerciser.
Figure 5:
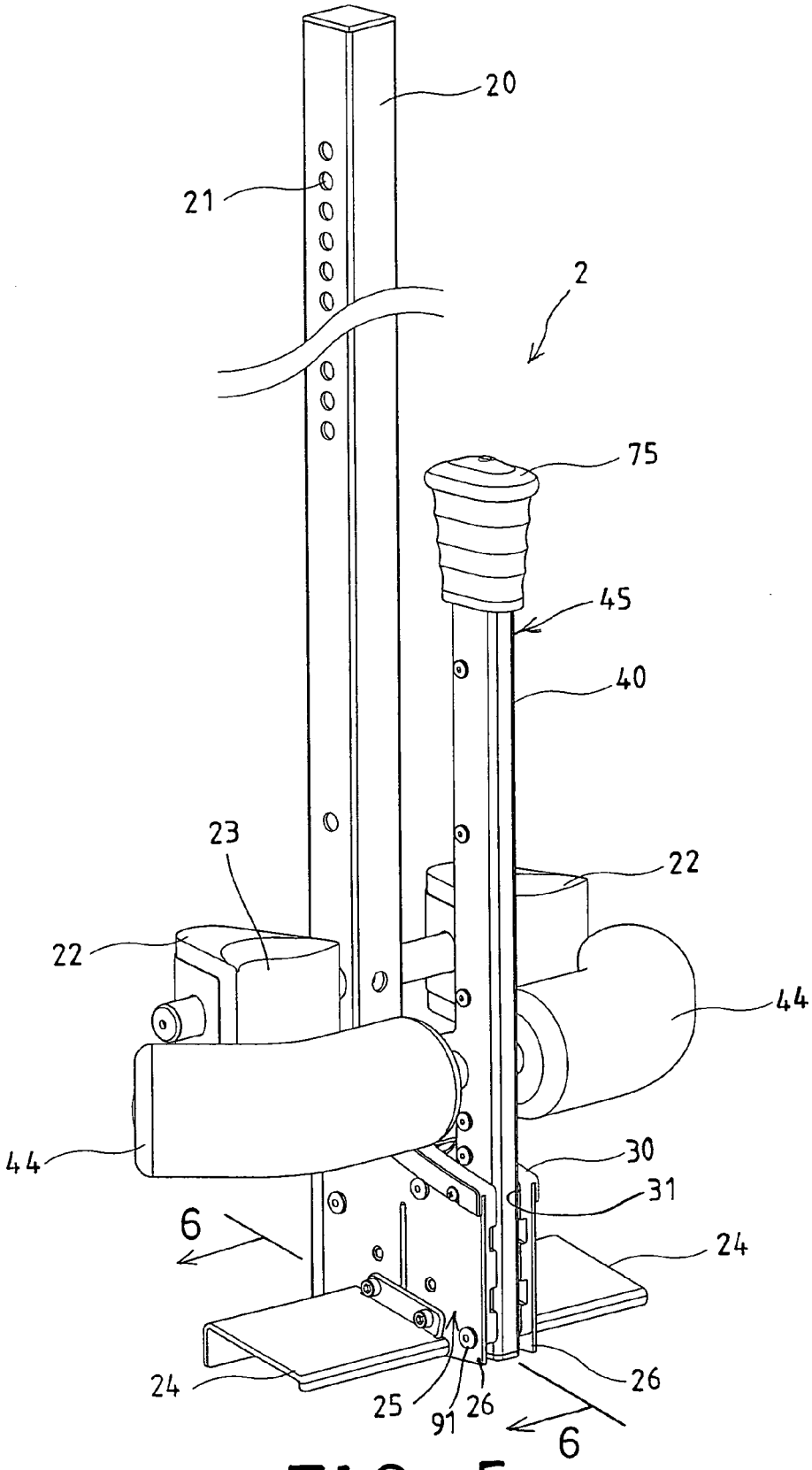
FIG. 5 is a perspective view of the foot retaining device for the inversion exerciser.
Figure 6:
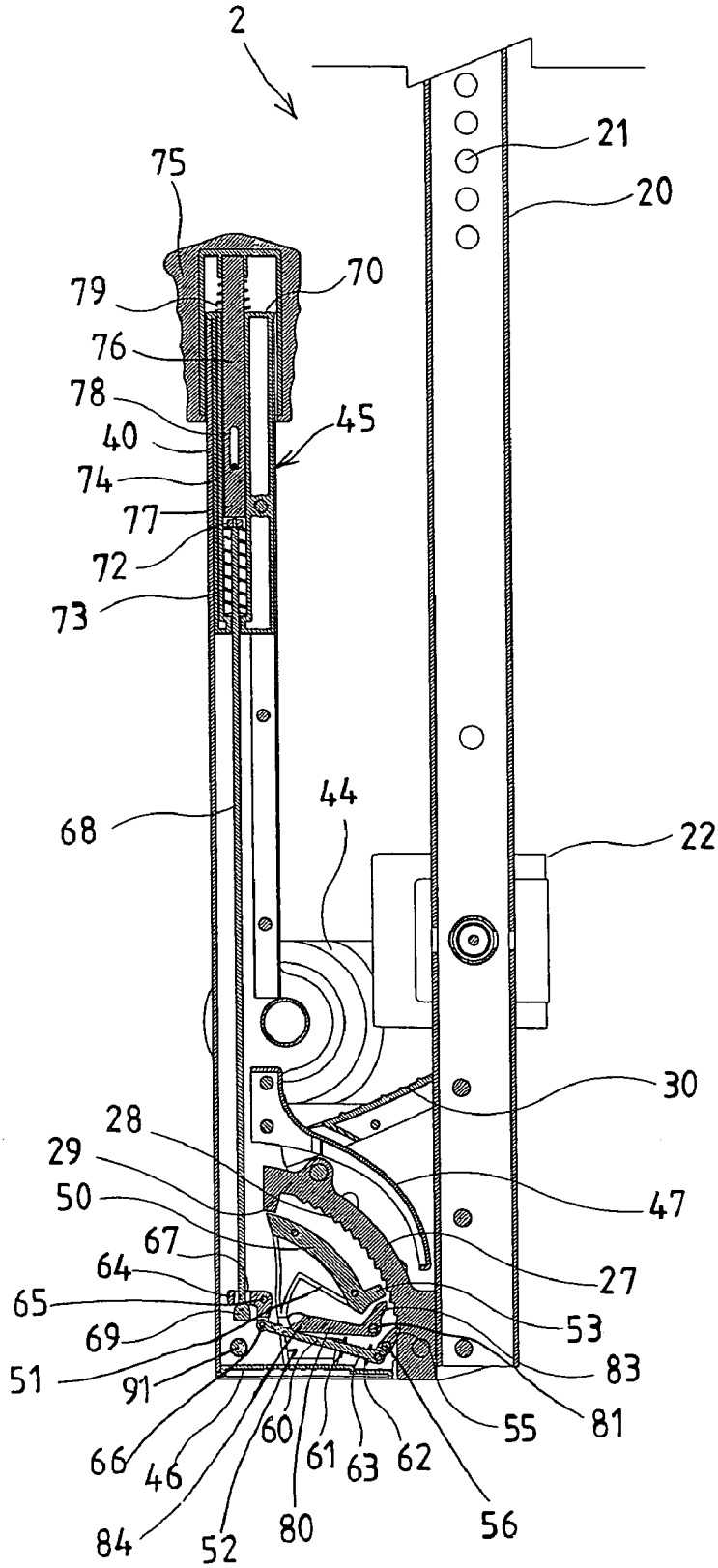
FIG. 6 is a partial cross sectional view of the foot retaining device, taken along lines 6—6 of FIG. 5.

For example, as shown in FIGS. 4–6, the foot retaining device 2 includes a beam 20 having a number of holes 21 formed therein, to adjustably secure to the base 11 with such as fasteners, latches (not shown), or the like, and thus to allow the foot retaining device 2 to be adjusted relative to the base 11. Two fixed foot supports 22 are attached to the beam 20, and each includes a curved and soft pad 23 attached thereto, to comfortably support the feet of the users 90, such as the ankle portions of the users 90 (FIGS. 1–3).

It is preferable that the foot retaining device 2 further includes two foot pedals 24 attached to the free end of the beam 20, to further stably support the feet of the users 90. A housing 25 includes two boards 26 secured to the free end of the beam 20, and/or secured to the foot pedals 24. A curved rack 27 is secured in the housing 25 or between the boards 26, and includes a number of teeth 28 formed or provided on a curved inner portion thereof, and includes a stop 29 extended therefrom. A cover 30 is secured to the housing 25, to enclose an outer peripheral portion of the housing 25, and includes a channel 31 formed therein.

A lever 40 includes one end or lower portion 41 rotatably or pivotally attached to the beam 20 or the housing 25 with a pivot shaft 91, and movably engaged in the channel 31 of the cover 30, to allow the lever 40 to be rotated relative to the beam 20 or to be moved toward and away from the beam 20 (FIGS. 6–11). The lever 40 includes a chamber 42 formed therein and defined between two plates 43, for receiving a control device 5 therein (FIG. 4) which will be described hereinafter.

The lever 40 includes two foot supports 44 attached thereto, and movable toward and away from the fixed foot supports 22 of the beam 20 by the lever 40, for clamping or retaining the feet of the users 90 to the beam 20, and to prevent the feet of the users 90 from being disengaged from the beam 20. The foot supports 44 of the lever 40 may thus be defined as movable foot supports 44 to selectively clamping the feet of the users 90 together with the fixed foot supports 22 of the beam 20.

The control device 5 is disposed in the chamber 42 of the lever 40, and preferably located in the lower portion 41 of the lever 40, and includes a block 50 secured in the chamber 42 of the lever 40 and having a notch 51 formed therein, and having a passage 52 formed therein and communicating with the notch 51 thereof. The block 50 includes a catch 53 extended therefrom, for engaging with the stop 29 of the housing 25 or of the beam 20 (FIGS. 9, 10), to limit the rotational movement of the lever 40 relative to the beam 20 and the housing 25.

The control device 5 further includes a pawl 55 rotatably or pivotally secured in the chamber 42 of the lever 40, and rotatable or movable to engage with the teeth 28 of the rack 27 (FIGS. 6–7, 10–11), and to lock the lever 40 to the beam 20 or to the housing 25. The pawl 55 may also be disengaged from the teeth 28 of the rack 27 (FIGS. 8, 9), to free the lever and to allow the lever 40 to be rotated or moved relative to the beam 20 and the housing 25.

Figure 7:
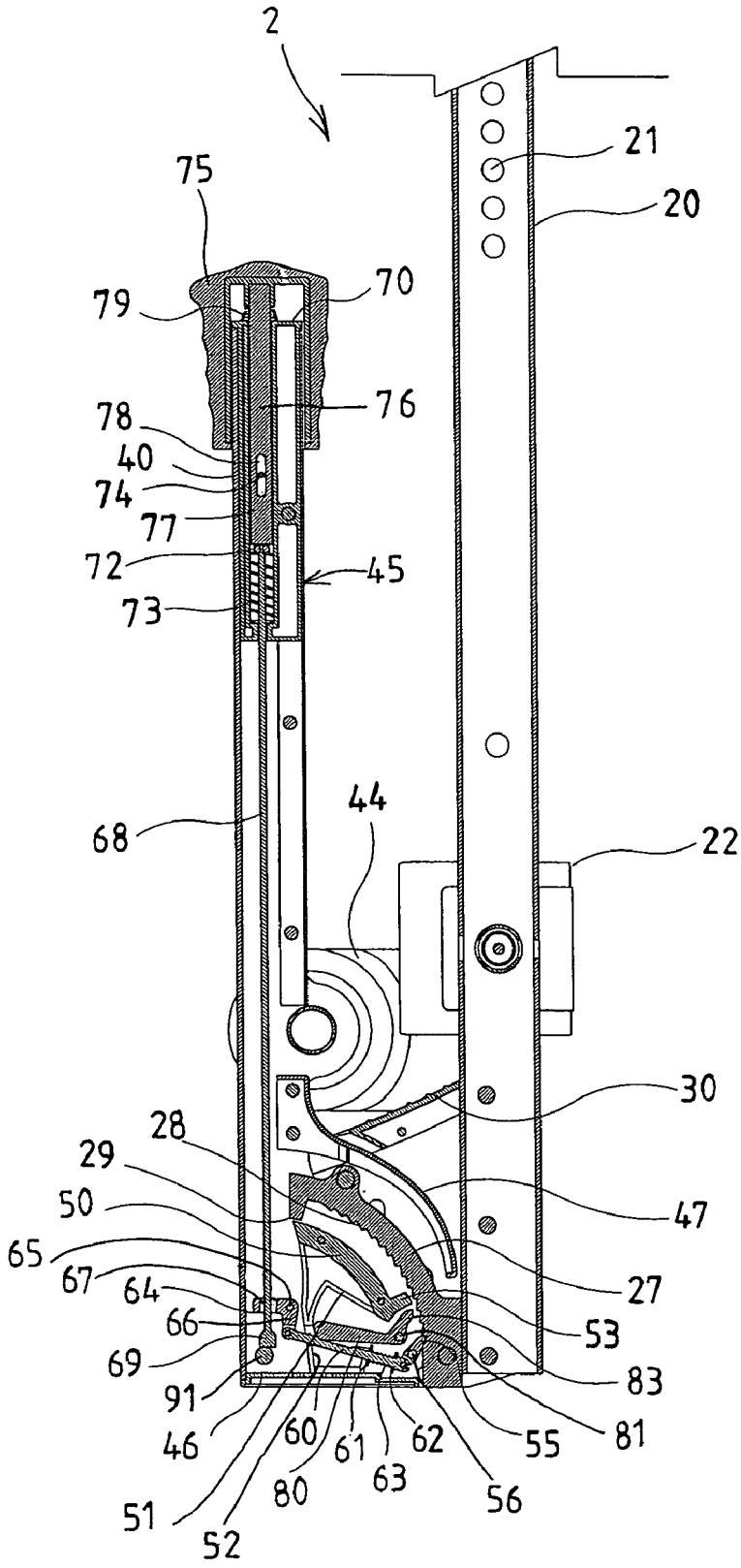
FIGS. 7, 8, 9, 10, 11 are partial cross sectional views similar to FIG. 6, illustrating the operation of the foot retaining device for the inversion or suspension exerciser.
Figure 8:
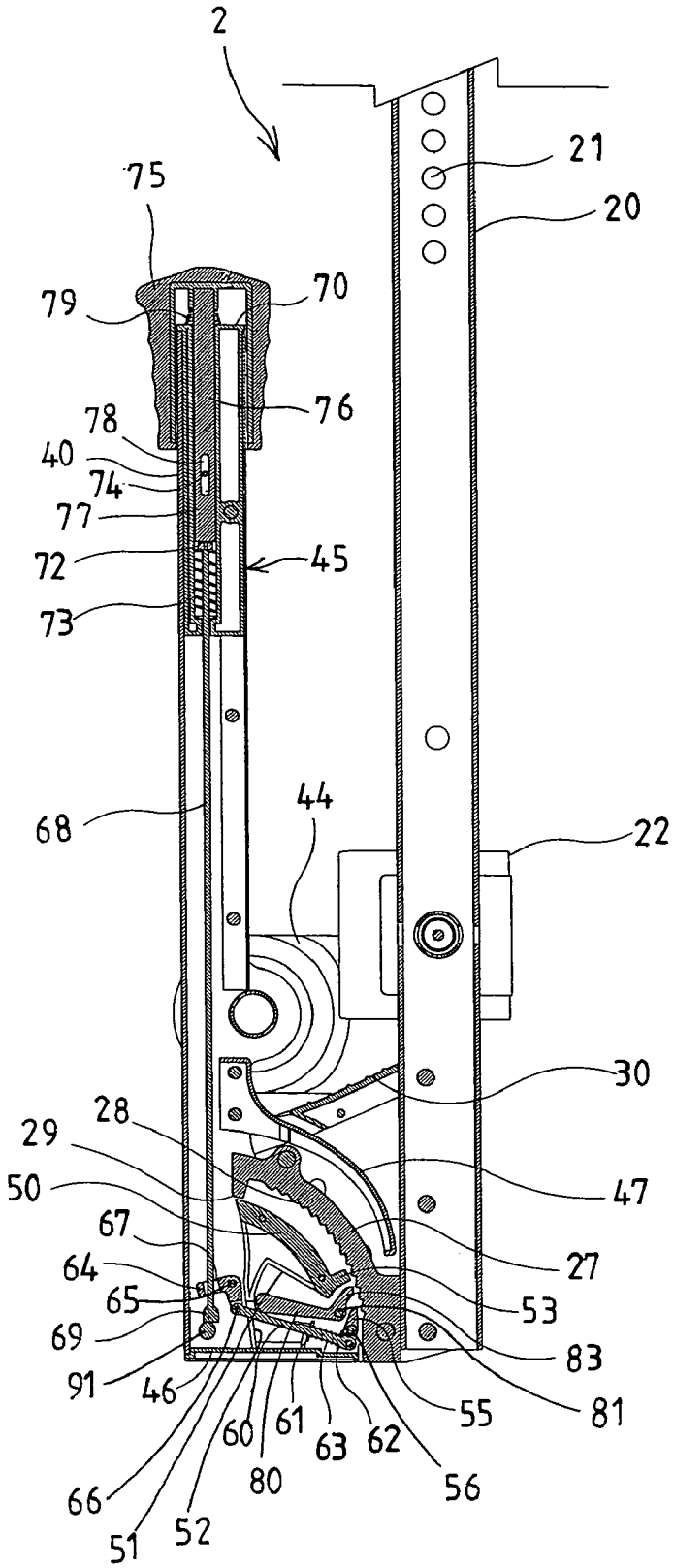
Figure 9:
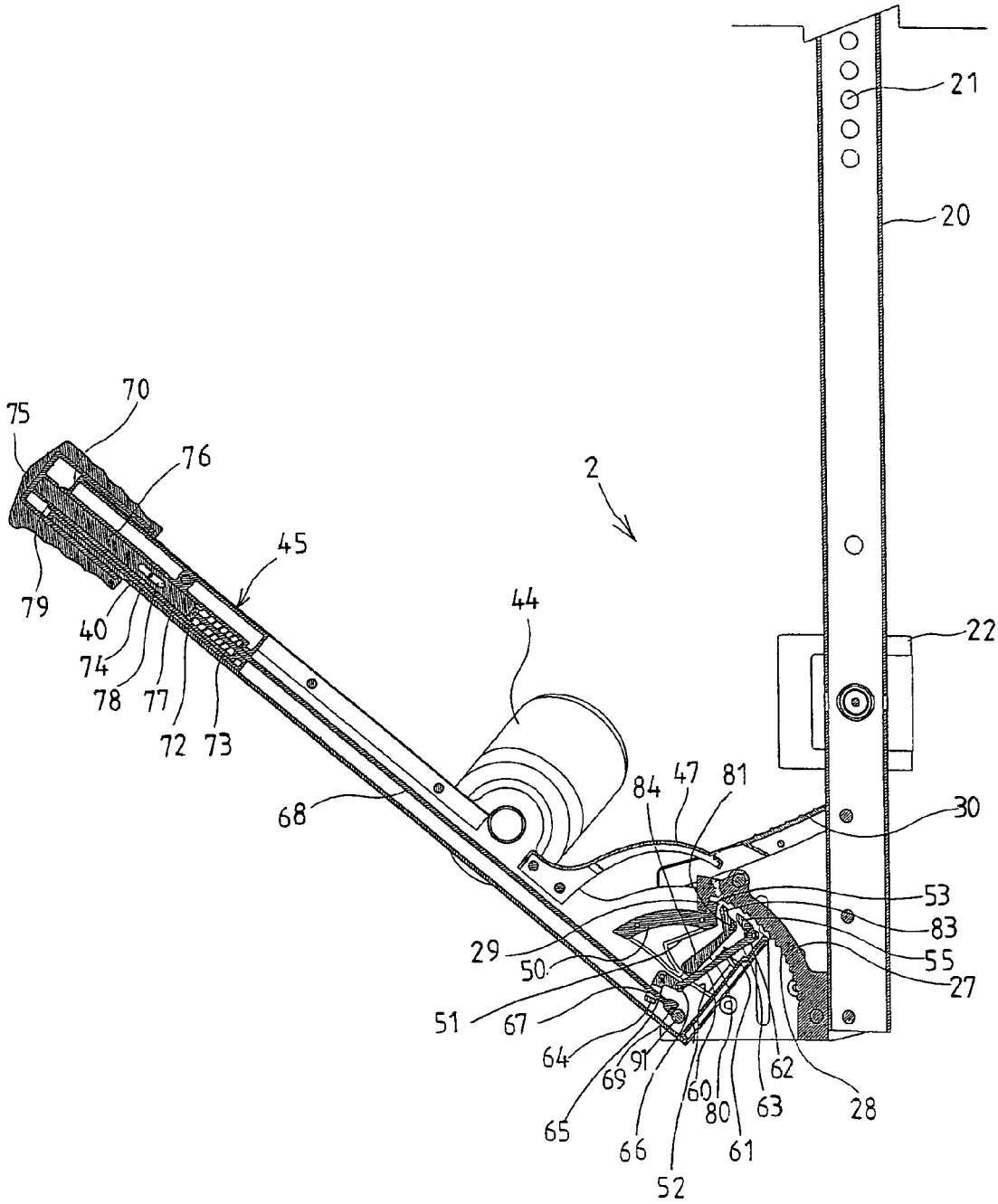
Figure 10:
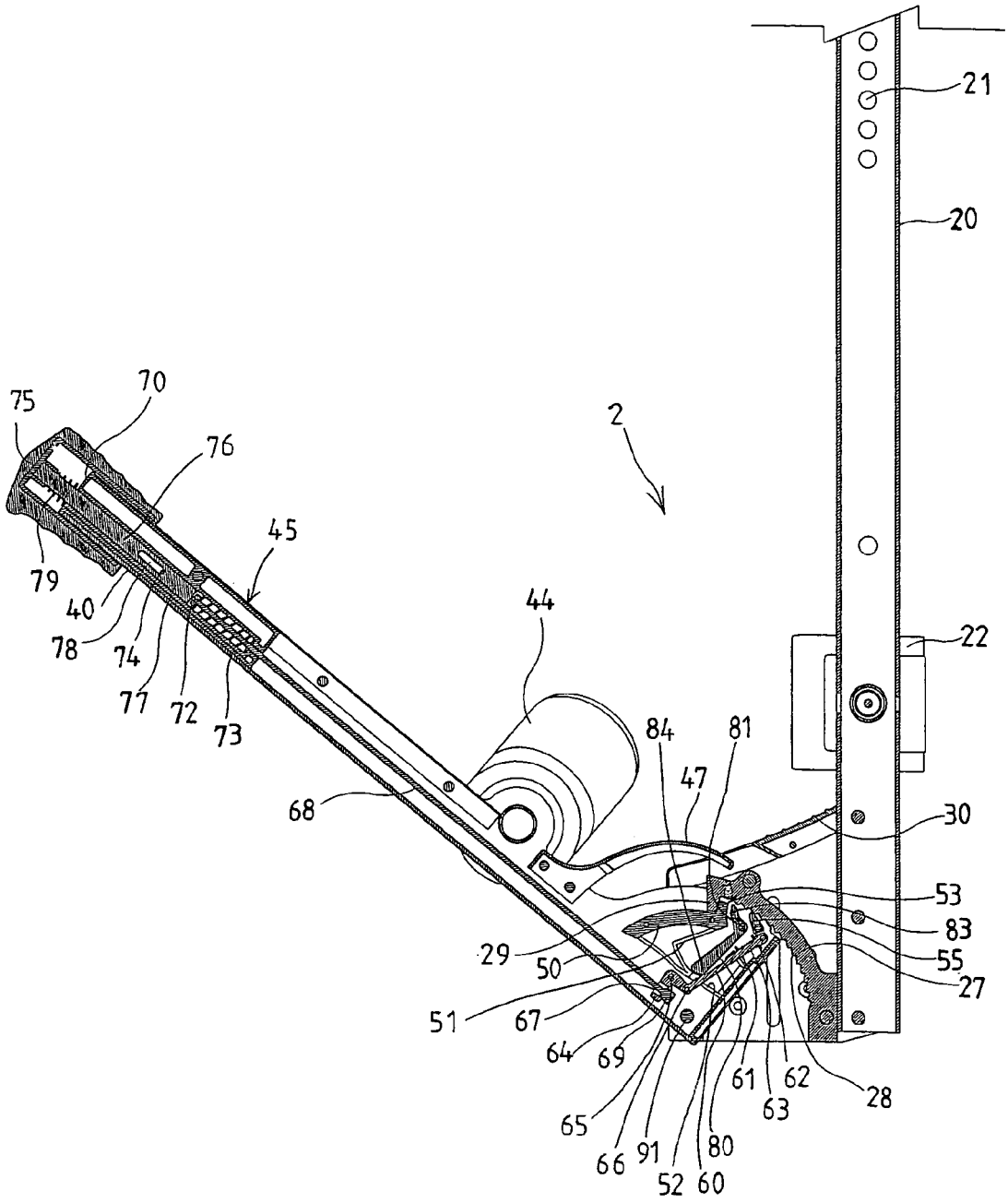
Figure 11:
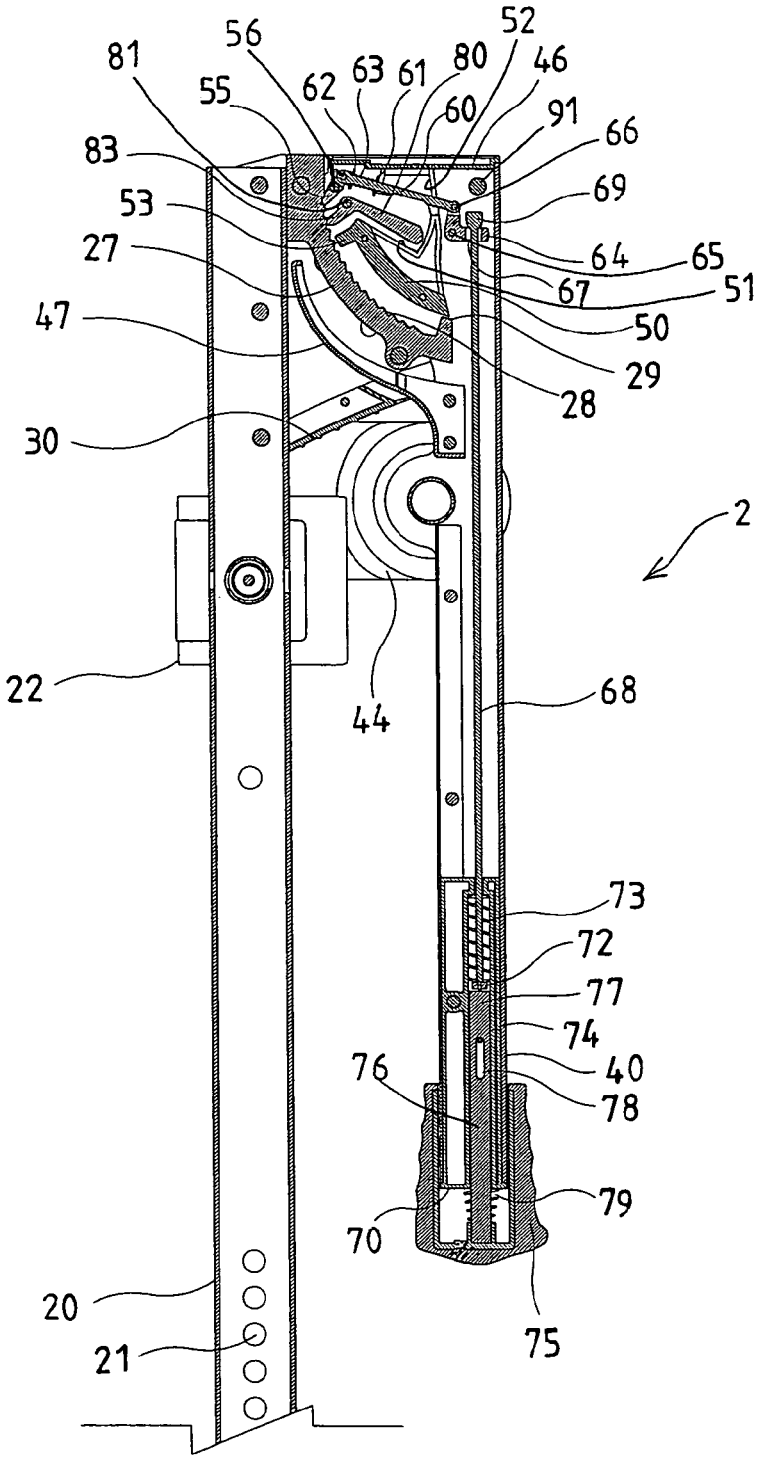

A rod 60 is slidably received in the passage 52 of the block 50, and includes one end pivotally coupled to the pawl 55, to rotate or to actuate the pawl 55 to engage with the teeth 28 of the rack 27 (FIGS. 6–7, 10–11), or to be disengaged from the teeth 28 of the rack 27 (FIGS. 8, 9). Two washers 61, 62 are slidably engaged on one end of the rod 60, and engaged with the block 50 and the pawl 55 respectively, and a spring 63 is also engaged on the rod 60, and engaged between the washers 61, 62 or between the pawl 55 and the block 50, to bias the rod 60 to rotate the pawl 55, and to disengaged the pawl 55 from the teeth 28 of the rack 27 (FIGS. 8, 9).

An elbow 64 includes a middle portion rotatably secured in the beam 20 or in the housing 25 with a pivot axle 65, and includes one end 66 rotatably or pivotally secured to the other end of the rod 60, and includes an orifice 67 formed in the other end thereof. The elbow 64 may be rotated or pivoted relative to the beam 20 or to the housing 25 about the pivot axle 65, to actuate the pawl 55 to engage with the teeth 28 of the rack 27, or to be disengaged from the teeth 28 of the rack 27.

A post 68 is slidably received in the chamber 42 of the lever 40, and extended through the orifice 67 of the elbow 64, and includes an enlarged head 69 formed on the lower end thereof, for engaging with the elbow 64 (FIGS. 6, 10 and 11), and for rotating the elbow 64 against the spring 63, in order to force or to actuate the pawl 55 to engage with the teeth 28 of the rack 27.

A casing 70 is secured in the chamber 42 of the lever 40 and located in the upper portion 45 of the lever 40, and includes a bore 71 formed therein, for slidably receiving an upper portion of the post 68. A head or a peg 72 is secured to the upper portion of the post 68, and a spring 73 is engaged onto the post 68, and engaged between the peg 72 or the upper portion of the post 68 and the casing 70, to bias the post 68 upwardly relative to the lever 40, and thus to force the head 69 of the post 68 to engage with the elbow 64, and to actuate the pawl 55 to engage with the teeth 28 of the rack 27. A pin 74 is engaged into the casing 70 and laterally engaged through the bore 71 of the casing 70.

A knob 75 is slidably engaged onto the upper portion 45 of the lever 40, and includes a stem 76 extended downwardly therefrom, and also slidably engaged into the bore 71 of the casing 70, and having a lower portion 77 contacted or engaged with the peg 72 or the upper portion of the post 68, for moving the post 68 downwardly against the spring 73, and thus for selectively disengaging the head 69 of the post 68 from the elbow 64 (FIGS. 7–9).

The stem 76 includes an oblong hole 78 formed in an intermediate portion thereof to slidably receive the pin 74, and thus to limit the sliding movement of the stem 76 and thus the knob 75 relative to the lever 40. Another spring 79 may further be provided and engaged onto the stem 76 and engaged between the knob 75 and the casing 70, to bias the knob 75 upwardly relative to the casing 70, and thus to allow the head 69 of the post 68 to be forced to engage with the elbow 64 by the spring 73.

The lever 40 may further include a bottom panel 46 secured to bottom thereof, to enclose the bottom portion of the chamber 42 thereof, and may further include a flap 47 secured to an intermediate portion thereof, to enclose a middle portion of the chamber 42 thereof, and may further include a cap 48 secured to the upper portion thereof, to enclose the upper portion of the chamber 42 thereof, and to stably retain the elements or members of the control device 5 within the chamber 42 of the lever 40.

In operation, as shown in FIGS. 7 and 8, when the knob 75 is depressed or forced downwardly toward the casing 70 against the spring 79 and/or the spring 73, the head 69 of the post 68 may be forced to be disengaged from the elbow 64, and the rod 60 may be biased toward the pawl 55 by the spring 63, to rotate the pawl 55, and thus to disengaged the pawl 55 from the teeth 28 of the rack 27, and thus to allow the lever 40 to be rotated or moved away from the beam 20 (FIGS. 9, 10), and thus to allow the feet of the users 90 to be engaged between the foot supports 22, 44.

When the knob 75 is released by the users, the spring 73 and/or the spring 79 may bias the post 68 upwardly relative to the lever 40, and thus to force the head 69 of the post 68 to engage with the elbow 64, and to actuate the pawl 55 to engage with the teeth 28 of the rack 27 (FIG. 10), such that the lever 40 may be latched or locked to the beam 20 again. However, at this moment, the engagement between the pawl 55 and the teeth 28 of the rack 27 allows the lever 40 to rotate or to move toward the beam 20 only, but may prevent the lever 40 from being rotated or moved away from the beam 20.

After the lever 40 has been rotated or moved away from the beam 20, and after the feet of the users 90 have been engaged between the foot supports 22, 44, the lever 40 may be rotated or moved toward the beam 20 again, to force the movable foot supports 44 toward the fixed foot supports 22, and to lock and retain the feet of the users 90 between the foot supports 22, 44, and thus to prevent the users from being disengaged from the base 11.

The foot retaining device 2 in accordance with the present invention further includes a safety lock device 80 having an intermediate portion rotatably or pivotally secured to the lever 41 with a pivot pole 81, and having a tongue 83 formed or provided on one end thereof, for selectively engaging with the teeth 28 of the rack 27, in order to selectively lock the lever 40 to the beam 20 or to the housing 25.

The safety lock device 80 is movably or rotatably received in the notch 51 of the block 50, in order to limit the rotational movement of the safety lock device 80 relative to the block 50 and the lever 40, and includes the other end 84 having a weight greater than that of the tongue 83, in order to force the tongue 83 to engage with the teeth 28 of the rack 27 by the gravity force (FIGS. 3, 11), and thus to further safely lock the lever 40 to the beam 20 or to the housing 25 automatically.

The typical inversion or suspension exercise devices fail to provide a safety lock device 80 having a tongue 83 to engage with the teeth 28 of the rack 27 by the gravity force and automatically, to prevent the users from operating or actuating the safety lock device 80 to lock the lever 40 to the beam 20 or to the housing 25 by themselves.

Accordingly, the foot retaining device for inversion exerciser in accordance with the present invention includes a safety lock device to safely lock the feet of the users to a supporting base, and to prevent the users from being disengaged from the supporting base when the feet of the users are suspended above their bodies, or while the users are conducting the inversion or suspension exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising:

a base rotatably attached to a stand to support a user thereon, and being able to rotate at least 180 degrees to allow users to conduct inversion or suspension, or to allow users to straighten the spinal column, a foot retaining device attached to said base, to secure feet of the user to said base, said foot retaining device including a beam secured to said base, and having two fixed foot supports attached to said beam, a housing secured to said beam and a curved rack secured in said housing and having a plurality of teeth provided thereon, a lever including a first end rotatably attached to said housing of said beam with a pivot shaft, said lever including two movable foot supports attached thereto, and movable toward and away from said fixed foot supports of said beam by said lever for retaining the feet of the user between said lever and said beam, a pawl pivotally secured in said lever, said pawl rotatable to engage with said teeth of said rack in order to selectively lock said lever to said beam, and rotatable disengageable from said teeth of said rack to free said lever and to allow said lever to be rotated relative to said beam, means for controlling said pawl to engage and disengage from said teeth of said rack, said means for controlling includes a spring engaged on a rod, and engaged between a block and said pawl to bias said rod to rotate said pawl and to disengage said pawl form said teeth of a rack, a safety lock having an intermediate portion pivotally secured in said lever with a pivot pole, said lock including a tongue provided on one end thereof, and arranged to selectively engage with said teeth of said rack and to selectively secure said lever to said beam by gravity force, said safety lock is rotatable received in a notch of said block in order to limit the rotational movement of the safety lock relative to said block and said lever, and said safety lock further including another end having a weight greater than that of said tongue, in order to force said tongue to engage with said teeth of said rack by the gravity force, said beam of said foot retaining device includes a plurality of holes formed to adjustably secure said beam of said foot retaining device to said base, wherein each of said fixed foot supports of said foot retaining device includes a soft pad attached thereto for comfortably supporting the feet of the user, and said foot retaining device includes two foot pedals attached to said beam to stably support the feet of the user.

2. An inversion exerciser comprising:

a base rotatably attached to a stand, to support a user thereon, and a foot retaining device attached to said base, to secure feet of the user to said base, said foot retaining device including a beam secure to said base, two fixed foot supports attached to said beam, a housing secured to said beam, a curved rack secured in said housing and having a plurality of teeth provided thereon, a lever including a first end rotatably attached to said housing of said beam with a pivot shaft, said lever including two movable foot supports attached thereto, and movable toward and away from said fixed foot supports of said beam by said lever, for retaining the feet of the user between said lever and said beam, a pawl pivotally secured in said lever, and rotatable to engage with said teeth of said rack, in order to selectively lock said lever to said beam, and rotatable to be disengaged from said teeth of said rack, to free said lever and to allow said lever to be rotated relative to said beam, means for controlling said pawl to engage and disengage from said teeth of said rack, and a safety lock device pivotally secured in said lever, and including a tongue provided on one end thereof, and arranged to selectively engage with said teeth of said rack and to selectively lock said lever to said beam by gravity force, and said lever including a block secured therein and having a notch formed therein to slidably receive said safety lock device, and to limit a rotational movement of said safety lock device relative to said lever said block of said foot retaining device includes a passage formed therein and in communication with said notch thereof, a rod slidably received in said passage of said block and having a first end pivotally coupled to said pawl to actuate said pawl to engage or disengage from said teeth of said rack of said foot retaining device wherein said rack includes a stop extended therefrom, and said block includes a catch extended therefrom for engaging with said stop of said rack and to limit a rotational movement of said lever relative to said beam.

3. The foot retaining device for inversion exerciser as claimed in claim 2, wherein said controlling means includes a spring engaged on said rod, and engaged between said block and said pawl, to bias said rod to rotate said pawl, and to disengaged said pawl from said teeth of said rack.

4. The foot retaining device for inversion exerciser as claimed in claim 3, wherein said rod includes two washers slidably engaged thereon, and engaged with said block and said pawl respectively, and said spring is engaged between said washers.

5. The foot retaining device for inversion exerciser as claimed in claim 2, wherein said controlling means includes an elbow having a middle portion rotatably secured in said beam with a pivot axle, and having a first end pivotally secured to said rod, and having an orifice formed in a second end thereof, a post slidably received in said lever and extended through said orifice of said elbow and having an enlarged head provided on one end thereof, for engaging with said elbow, and for rotating said elbow to actuate said pawl to engage with said teeth of said rack.

6. The foot retaining device for inversion exerciser as claimed in claim 5, wherein said controlling means includes a casing secured in an upper portion of said lever, and having a bore formed therein, to slidably receive an upper portion of said post, a spring engaged between said post and said casing, to bias said head of said post to engage with said elbow.

7. The foot retaining device for inversion exerciser as claimed in claim 6, wherein a knob is slidably engaged onto said lever and includes a stem extended downwardly therefrom and slidably engaged into said bore of said casing, and having a lower portion engaged with said post, for moving said post against said spring, to selectively disengage said head of said post from said elbow.

8. The foot retaining device for inversion exerciser as claimed in claim 7, wherein said casing includes a pin engaged therein, said stem includes an oblong hole formed therein to slidably receive said pin, and to limit a sliding movement of said stem and said knob relative to said lever.

9. The foot retaining device for inversion exerciser as claimed in claim 8, wherein said knob includes a second spring engaged onto said stem and engaged between said knob and said casing, to bias said knob away from said casing.

* * * * *